US008403476B2

(12) United States Patent
Kawamura et al.

(10) Patent No.: US 8,403,476 B2
(45) Date of Patent: Mar. 26, 2013

(54) IMAGE FORMING APPARATUS AND METHOD FOR CONTROLLING THE SAME

(75) Inventors: Takuya Kawamura, Tokyo (JP); Takashi Tsuzuki, Kawasaki (JP); Nobuyoshi Tanaka, Tokyo (JP); Yoshiyuki Hosokawa, Tokyo (JP); Hirofumi Narita, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 1189 days.

(21) Appl. No.: 12/194,474

(22) Filed: Aug. 19, 2008

(65) Prior Publication Data

US 2009/0052913 A1 Feb. 26, 2009

(30) Foreign Application Priority Data

Aug. 23, 2007 (JP) ..... 2007-217381

(51) Int. Cl.
*B41J 2/01* (2006.01)

(52) U.S. Cl. ..... 347/102; 347/101

(58) Field of Classification Search ..... 271/279; 347/16

See application file for complete search history.

(56) References Cited

U.S. PATENT DOCUMENTS

2004/0263553 A1* 12/2004 Mizuno ..... 347/16
2009/0102908 A1* 4/2009 Imoto ..... 347/104

FOREIGN PATENT DOCUMENTS

JP 2001089003 A 4/2001
JP 2006103849 A * 4/2006
JP 2006-168014 6/2006
JP 2006264828 A 10/2006

* cited by examiner

*Primary Examiner* — Matthew Luu
*Assistant Examiner* — Renee I Wilson
(74) *Attorney, Agent, or Firm* — Canon U.S.A., Inc. IP Division

(57) ABSTRACT

An image forming apparatus includes a first sheet discharge unit, a second sheet discharge unit, a switching unit configured to cause a sheet discharge destination to switch between the first sheet discharge unit and the second sheet discharge unit, a memory unit configured to store information about drying time of a print medium, a timer unit configured to determine elapse of the drying time of the printed print medium based on the information stored in the memory unit, and a control unit configured to control the switching unit to set the first sheet discharge unit to be the sheet discharge destination based on a determination of the timer unit that a drying time of a print medium discharged to the first sheet discharge unit has elapsed.

6 Claims, 7 Drawing Sheets

IMAGE FORMING APPARATUS AND METHOD FOR CONTROLLING THE SAME

BACKGROUND OF THE INVENTION

1. Field of the Invention

The present invention relates to an image forming apparatus for printing image data.

2. Description of the Related Art

Conventionally, an image forming apparatus executes a fixing process to stabilize an image formed on an output medium to be durable for practical use. In an image forming apparatus using ink, such as an inkjet type printer, drying of ink corresponds to the fixing process described herein.

Drying time of ink varies according to a combination of ink properties and an output medium property. Some output media require ink drying time which is barely-troublesome to users, while some other output media require users to wait for a predetermined time to secure the ink drying time, even though same ink is used.

By idling in the drying time, user-friendliness is lost while an image cannot be preserved in a stable condition if sufficient amount of the drying time is not secured.

Conventionally, various methods for optimizing the drying time are proposed. For example, an automatic control method for optimizing ink drying time according to date information and location information is discussed in Japanese Patent Application Laid-Open No. 2006-168014. (Refer to a paragraph 0007 and FIG. 9)

Meanwhile, conventional techniques have their limits to handle cases where a large number of sheets is printed with high image quality, such as an advertising poster. While in printing with high image quality an exclusive print medium is often used, the drying time of such print medium is often long in general. Therefore, a problem remains that users are kept waiting even though the processes are optimized.

SUMMARY OF THE INVENTION

The present invention is directed to an image forming apparatus and a method for controlling the same that prints a large number of sheets with high image quality using an exclusive print medium, and improves throughput of an entire job by inserting a printing job having shorter print drying time in cases where the print medium has long drying time.

According to an aspect of the present invention, an image forming apparatus comprises a first sheet discharge unit, a second sheet discharge unit, a switching unit configured to cause a sheet discharge destination to switch between the first sheet discharge unit and the second sheet discharge unit, a memory unit configured to store information about drying time of a print medium, a timer unit configured to determine elapse of the drying time of the printed print medium based on the information stored in the memory unit, and a control unit configured to control the switching unit to set the first sheet discharge unit to be the sheet discharge destination based on a determination of the timer unit that a drying time of a print medium discharged to the first sheet discharge unit has elapsed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
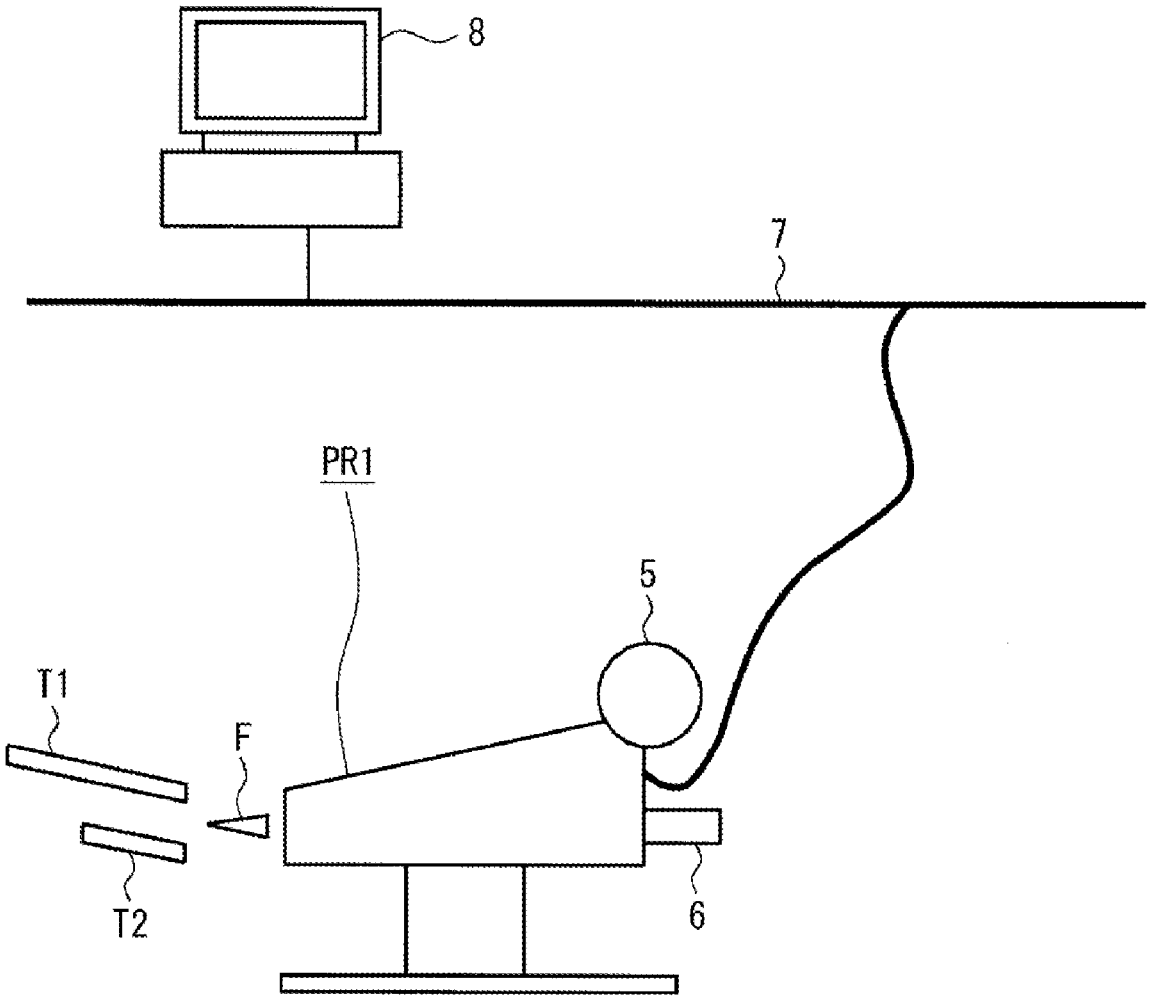
FIG. 1 is a cross-sectional view illustrating an image forming apparatus according to a first exemplary embodiment of the present invention.

FIG. 1 is a cross-sectional view illustrating an image forming apparatus PR1 according to the first exemplary embodiment of the present invention.

The image forming apparatus PR1 includes a first sheet discharge tray T1, a second sheet discharge tray T2, a flapper F, a roll sheet feeding unit 5, and a cassette sheet feeding unit 6. The image forming apparatus PR1 is connected to a host personal computer (PC) 8 via a network 7, such as local area network (LAN).

The image forming apparatus PR1 is a large-format inkjet printer.

The flapper F switches a sheet discharge destination between the first sheet discharge tray T1 and the second sheet discharge tray T2.

Although the image forming apparatus PR1 is an inkjet type printer, any printers having a printing engine that performs fixing by drying ink are applicable to the image forming apparatus other than the inkjet type.

The present exemplary embodiment is applicable to not only a large-format printer but also a desktop type printer that performs cassette sheet feeding and manual sheet feeding and a multifunctional peripheral having a plurality of sheet feeding racks.

Further, the image forming apparatus PR1 has a network connection unit as an external interface (I/F) unit and may be connected to a printer server separately arranged via a Universal Serial Bus (USB) and IEEE1394.

Figure 2:
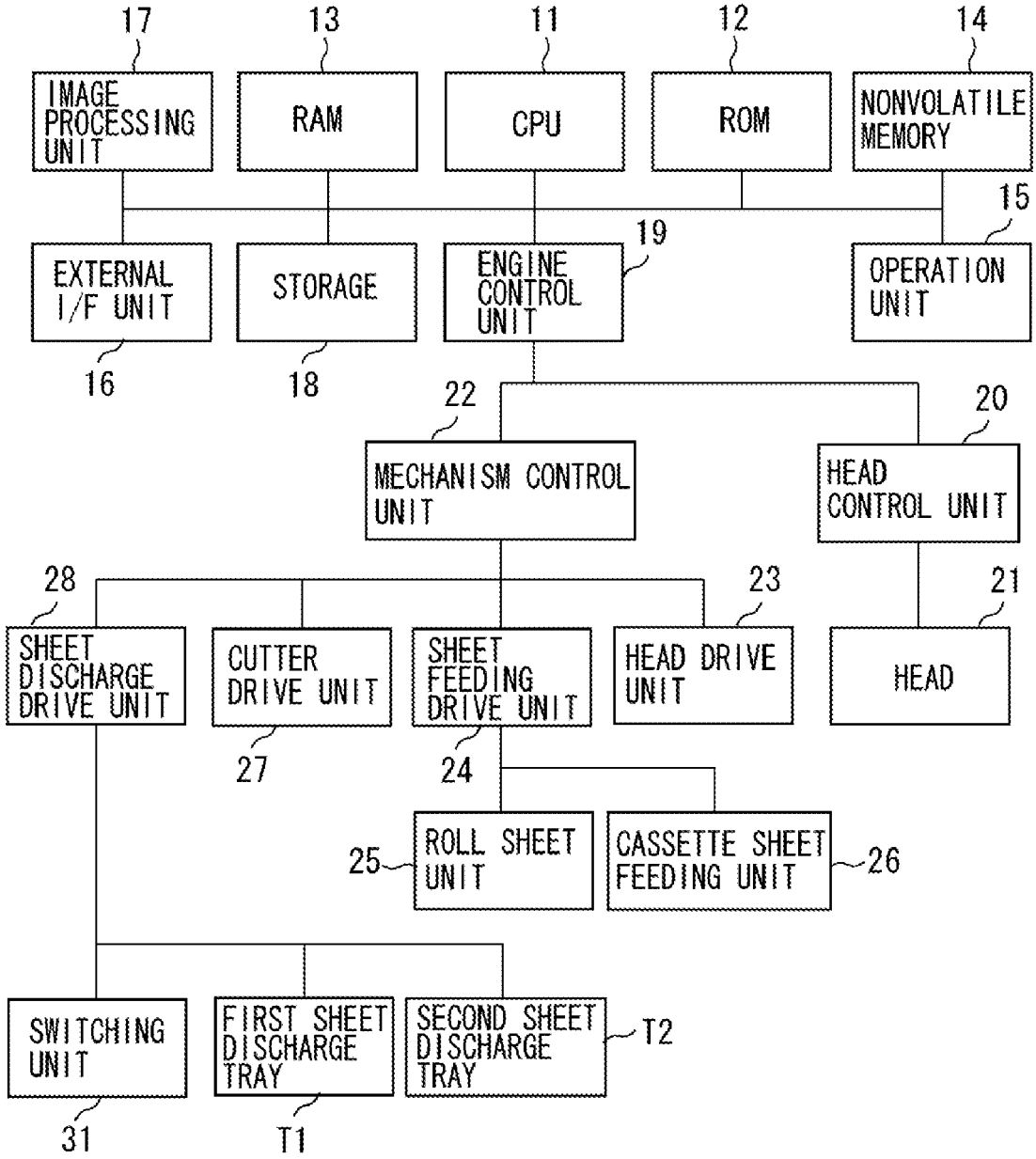
FIG. 2 is a block diagram illustrating a structure of the image forming apparatus illustrated in FIG. 1.

FIG. 2 is a block diagram illustrating a structure of the image forming apparatus PR1.

The image forming apparatus PR1 has a central processing unit (CPU) 11, a read-only memory (ROM) 12, a random access memory (RAM) 13, a nonvolatile memory 14, an operation unit 15, an external I/F unit 16, an image processing unit 17, a storage 18, an engine control unit 19, a head control unit 20 and a printer head 21. The image forming apparatus PR1 further has a mechanism control unit 22, a head drive unit 23, a sheet feeding drive unit 24, a roll sheet unit 25, a cassette sheet feeding unit 26, a cutter drive unit 27, a sheet discharge drive unit 28, the first sheet discharge tray T1, the second sheet discharge tray T2 and a switching unit 31.

The CPU 11 performs control of the image forming apparatus PR1 and an analysis and execution of external commands. The CPU 11 has a timer unit for generating various timer events. The CPU 11 executes programs read out from the ROM 12 to control the image forming apparatus PR1.

The RAM 13 has an image memory region where externally received image data is stored, and a work memory region where the CPU 11 executes a program, and these memory regions are mutually independent and secured on the RAM 13.

The nonvolatile memory 14 includes a flash ROM and an electrically erasable and programmable ROM (EEPROM). A setting value, such as a type of a print medium presently set in the image forming apparatus PR1, is stored in a nonvolatile state on the nonvolatile memory 14. The nonvolatile memory 14 can maintain stored data without power supply from an electric power source. Information about drying time corresponding to the type of the print medium is stored in the nonvolatile memory 14.

The CPU 11 reads out the information about the drying time corresponding to the print medium used in a printing job from the nonvolatile memory 14.

The operation unit 15 displays a message from the CPU 11 to a user on a liquid crystal display (LCD) and a light emitting diode (LED), and inputs an instruction from the user to the CPU 11 using a key input device. The external I/F unit 16 has a configuration capable of transmitting and receiving various data via a network protocol, such as an internet protocol (IP).

The storage 18 stores image data received via the external I/F unit 16. The image processing unit 17 reads out the image data received by the external I/F unit 16 from the storage 18, stores the data into the image memory region on the RAM 13, and rasterizes the data according to an instruction from the CPU 11. The rasterized data is pixel data that can be printed by the engine control unit 19.

The engine control unit 19 controls each unit in the image forming apparatus PR1 and executes a printing operation. The head control unit 20 controls the printer head 21 to execute drawing of each pixel. The mechanism control unit 22 controls the head drive unit 23, the sheet feeding drive unit 24, the cutter drive unit 27 and the sheet discharge drive unit 28, and prints pixel data.

When sheets are fed from the roll sheet unit 25, the cutter drive unit 27 cuts the sheets as outputting sheets. When sheets are fed from the cassette sheet feeding unit 26, the cutter drive unit does not cut the sheets. The sheet feeding drive unit 24 selects the sheet feeding unit as a sheet feeding source according to an instruction from the CPU 11.

As described above, the information about the drying time of the print medium is provided corresponding to the type of the print medium, and preliminarily stored in the nonvolatile memory 14. When the print medium is set to the roll sheet unit 25 or the cassette sheet feeding unit 26, the information of the drying time is read out according to the type of the print medium which is input from the operation unit 15, and the drying time is determined by the CPU 11.

As described above, the CPU 11 calculates the drying time of the print medium that is printed and discharged to the first sheet discharge tray T1 or the second sheet discharge tray T2, from the drying time information and the image data (an amount of ink recorded on the print medium) to determine the elapse of the drying time.

The sheet discharge drive unit 28 drives the first sheet discharge tray T1, the second sheet discharge tray T2 and the switching unit 31. The switching unit 31 drives the flapper F for switching the sheet discharge destination. The CPU 11 and the engine control unit 19 cooperatively print the image that the image processing unit 17 has created in the storage 18 on the print medium.

Figure 3:
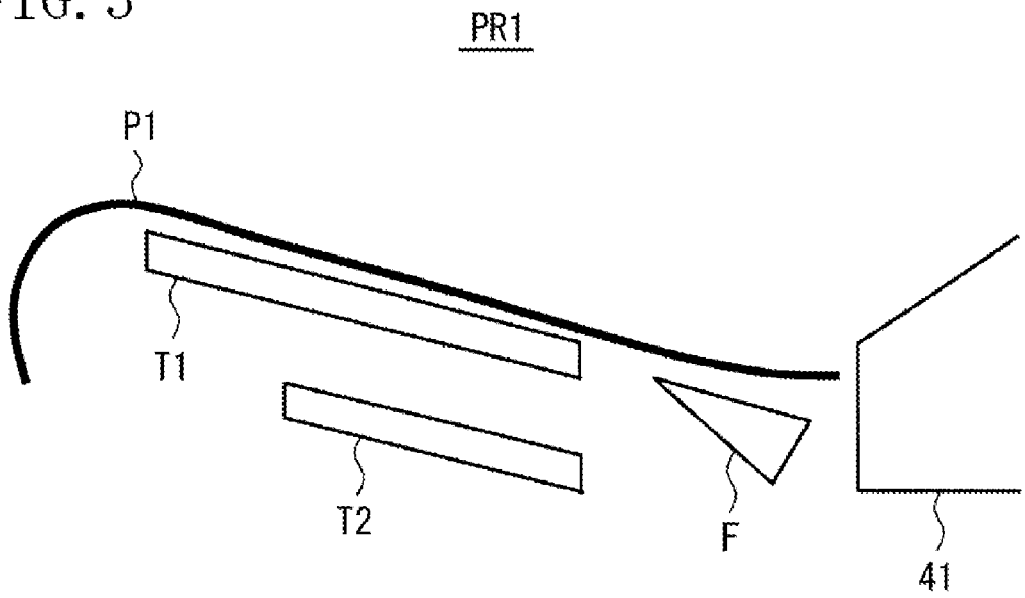
FIG. 3 is a diagram illustrating an example method of switching a sheet discharge tray in the image forming apparatus illustrated in FIG. 1.

FIG. 3 is a diagram illustrating an example of switching the sheet discharge tray in the image forming apparatus PR1.

The image forming apparatus PR1 has a body discharge port 41. The flapper F switches the sheet discharge destination between the first sheet discharge tray T1 and the second sheet discharge tray T2.

The flapper F is set toward the first sheet discharge tray T1 in FIG. 3, thus a first print medium P1 is discharged to the first sheet discharge tray T1.

Figure 4:
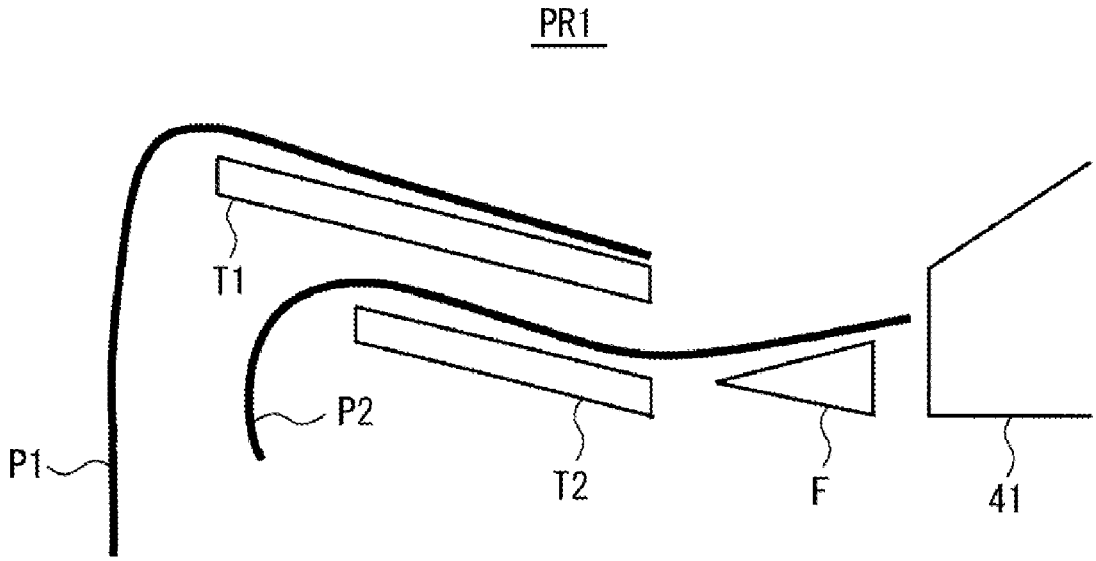
FIG. 4 is a diagram illustrating a state of a second print medium in the image forming apparatus illustrated in FIG. 1.

FIG. 4 is a diagram illustrating a state of a second print medium P2 in the image forming apparatus PR1.

The flapper F is set toward the second sheet discharge tray T2 in FIG. 4. The second print medium P2 is discharged to the second sheet discharge tray T2. The first print medium P1 waits for the drying time to elapse on the first sheet discharge tray T1 during the printing of the second print medium P2.

Figure 5:
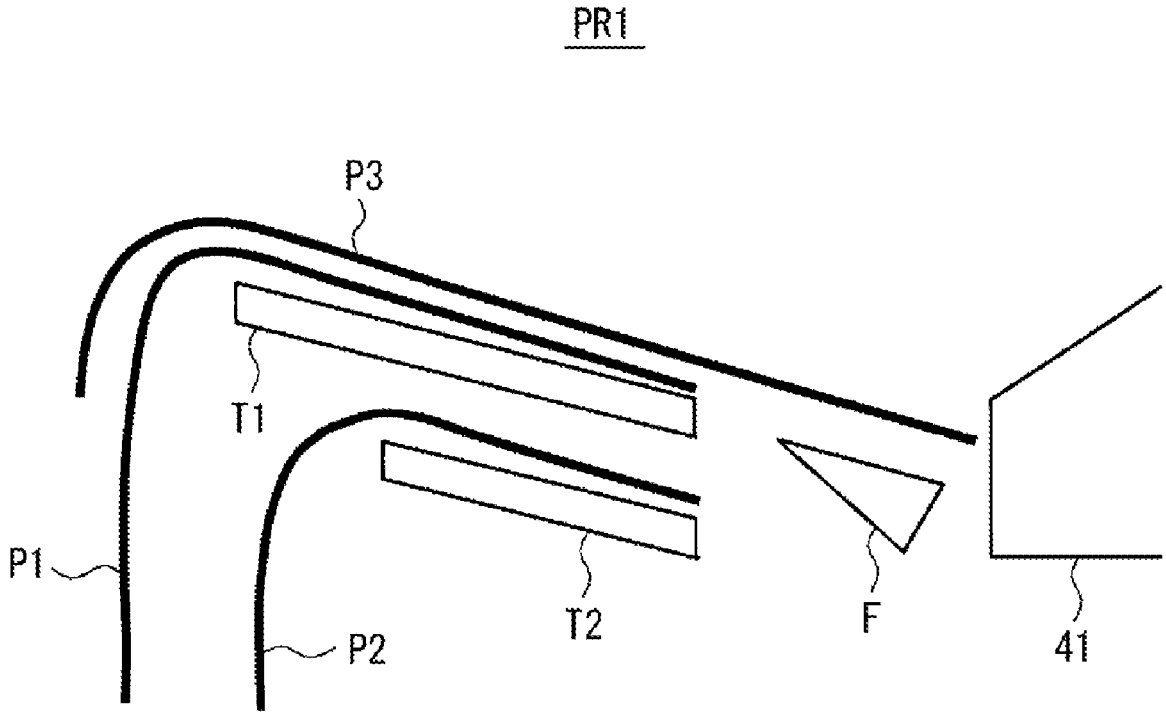
FIG. 5 is a diagram illustrating a state of a third print medium in the image forming apparatus illustrated in FIG. 1.

FIG. 5 is a diagram illustrating a state of a third print medium P3 in the image forming apparatus PR1.

The flapper F is set toward the first sheet discharge tray T1. The third print medium P3 is discharged to the first sheet discharge tray T1. The third print medium P3 is discharged onto the first print medium P1, and by this time the first print medium P1 has already been dried.

Figure 6:
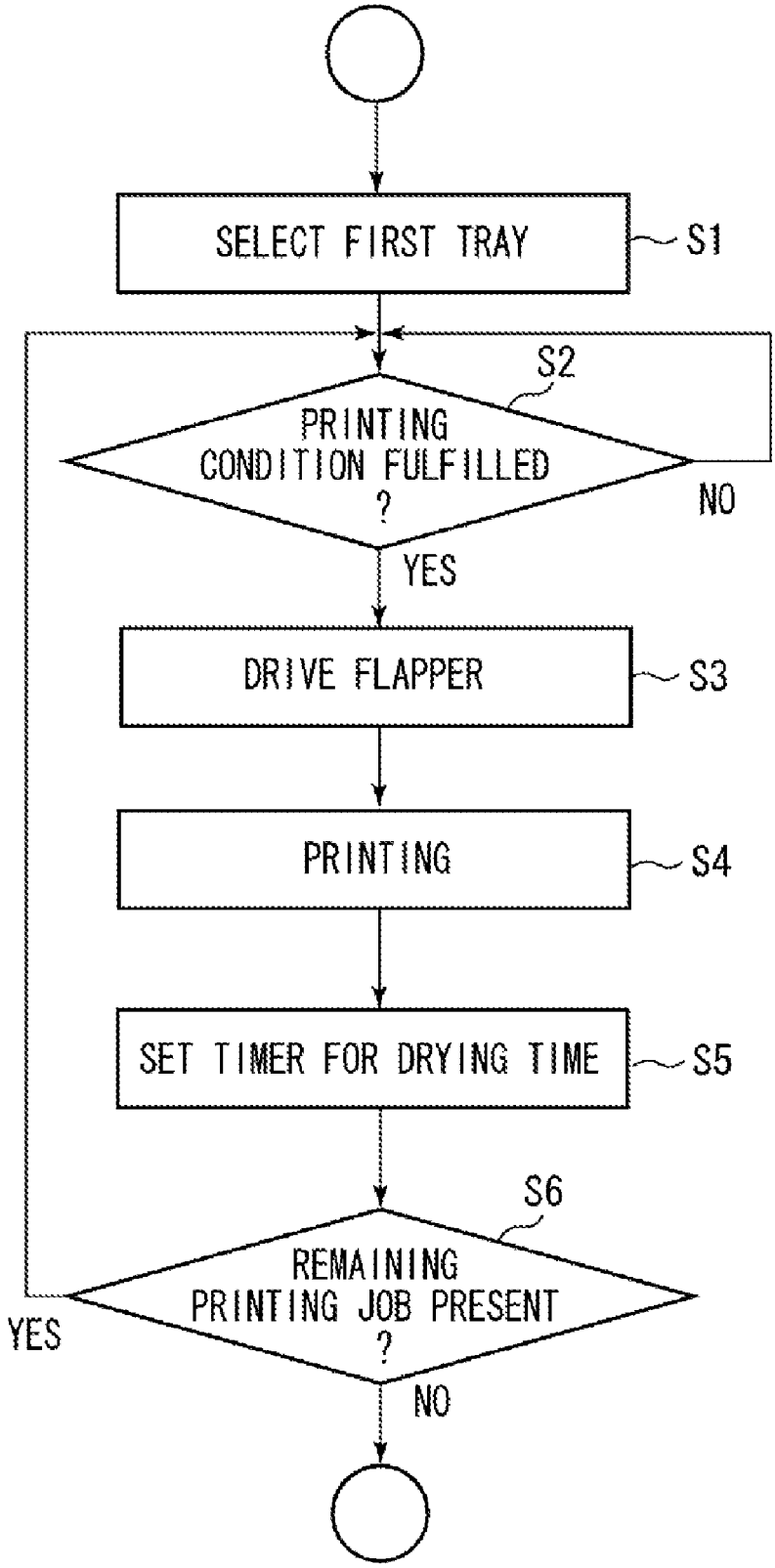
FIG. 6 is a flow chart illustrating a control operation of the image forming apparatus illustrated in FIG. 1.

FIG. 6 is a flow chart illustrating the control operation of the image forming apparatus PR1.

A program in the flow chart illustrated in FIG. 6 is stored by the ROM 12 and executed by the CPU 11.

In step S1, the CPU 11 selects a sheet discharge tray that discharges the sheet at first. In step S2, the CPU 11 determines whether a printing condition is fulfilled. The printing condition includes a requirement that the drying time of a preceding print medium on the sheet discharge tray of the sheet discharge destination has already elapsed and no print medium currently under printing is present at the flapper F. The flapper F cannot be switched when a print medium being printed is present at the flapper F. If it is determined that the printing condition is fulfilled (YES in step S2), the process proceeds to step S3. If the printing condition is not fulfilled (NO in step S2), the process returns to step S2, and the CPU 11 waits until the printing condition is fulfilled. In step S3, the CPU 11 switches the direction of the flapper F. In step S4, the CPU 11 executes the printing on a print medium. In step S5, the CPU 11 sets the drying time of the print medium printed in step S4 into a timer. In step S6, the CPU 11 determines whether the next printing data exists. If the next printing data does not exist (NO in step S6), the CPU 11 ends the printing process. If the next printing data exists (YES in step S6), the process returns to step S2.

Second Exemplary Embodiment

Figure 7:
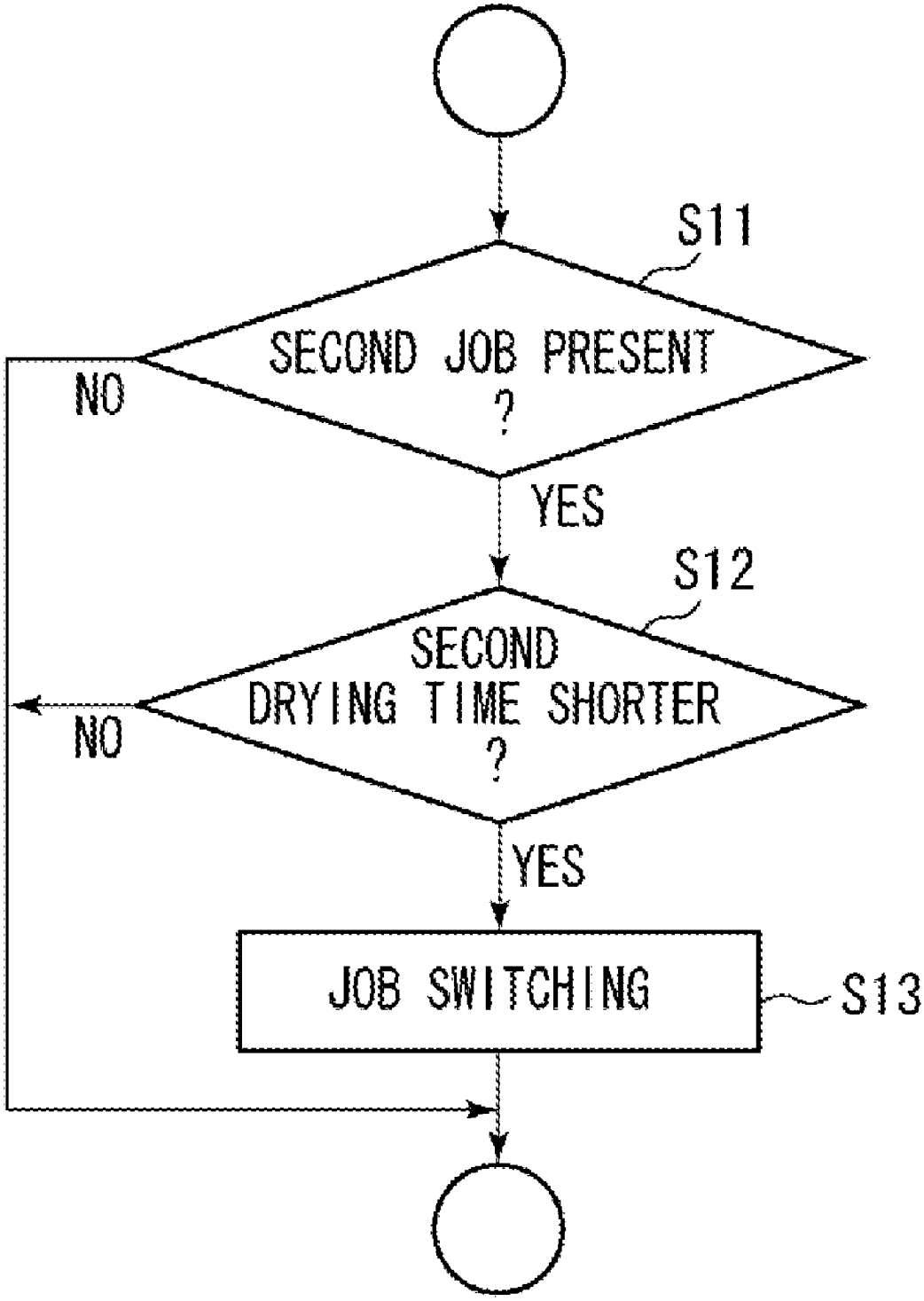
FIG. 7 is a flow chart illustrating an operation of an image forming apparatus according to a second exemplary embodiment of the present invention.

FIG. 7 is a flow chart illustrating the operation of the image forming apparatus according to the second exemplary embodiment of the present invention.

A program in the flow chart illustrated in FIG. 7 is stored by the ROM 12 and executed by the CPU 11.

In step S11, the CPU 11 determines whether a second printing job exists, in addition to a first printing job presently under printing. If the second printing job exists (YES in step S11), the process proceeds to step S12. On the other hand, if the second printing job does not exist (NO in step S11), the CPU 11 ends the process. In step S12, the CPU 11 compares time length required for completing drying of the print medium of the second printing job to that of the print medium of the first printing job. If the drying time of the print media of the second printing job is shorter (YES in step S12), the process proceeds to step S13. On the other hand, if the drying time of the print medium of the first printing job is shorter (NO in step S12), the CPU 11 ends the process. In step S13, the CPU 11 executes a printing job switching process illustrated in FIG. 8.

When the jobs are controlled as illustrated in the flow chart in FIG. 7, a job having longer drying time cannot be inserted. More specifically, if the job having the longer drying time is inserted, the print medium with a longer drying time is discharged to both the first sheet discharge tray T1 and the second sheet discharge tray T2. When the sheet discharge trays are all occupied by the print medium having a longer drying time, the start of the next printing job is delayed. Therefore, when higher priority is given to a printing job that requires a drying time shorter than the drying time required in the first printing job, an entire throughput of the jobs waiting for print can be increased.

Figure 8:
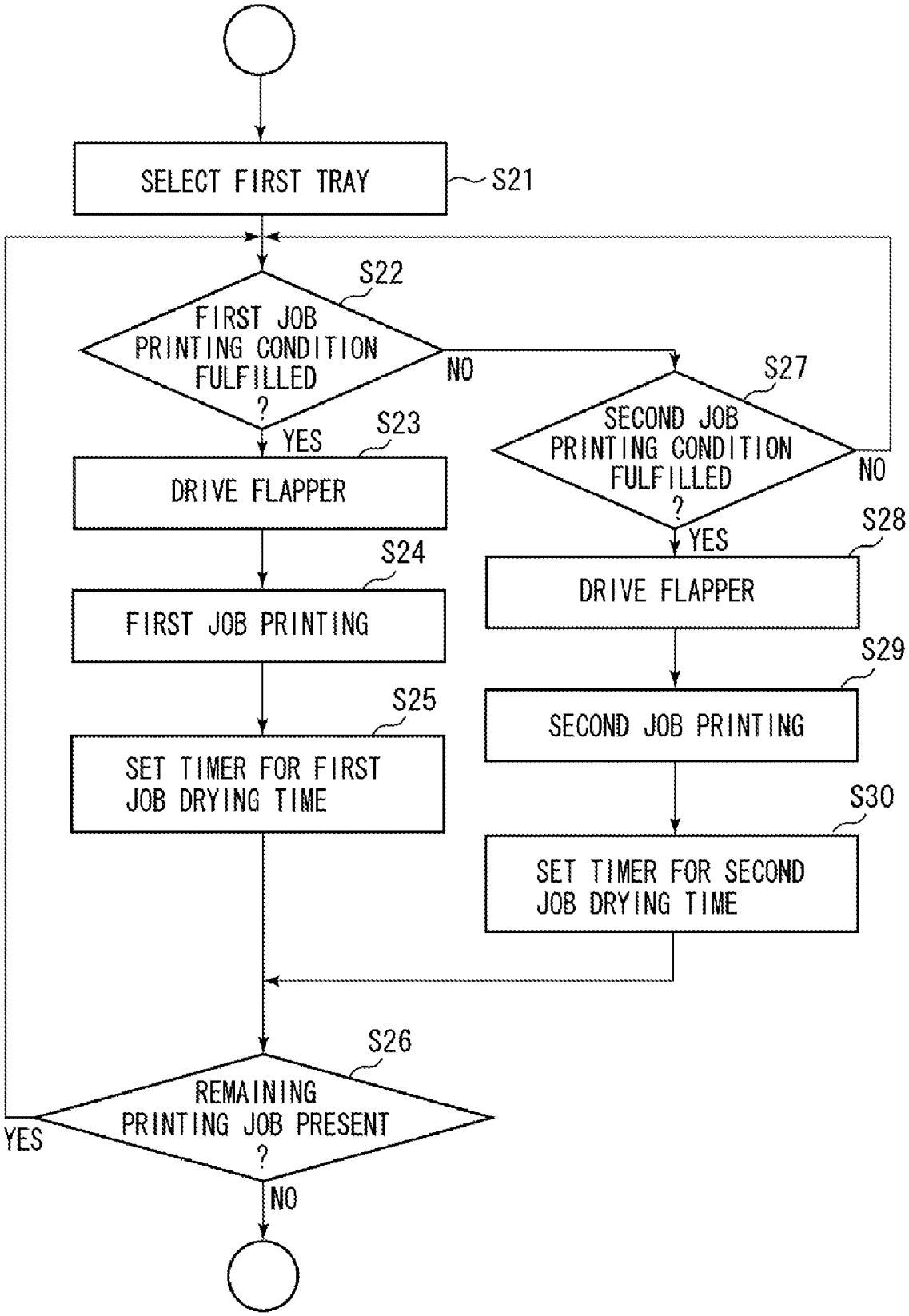
FIG. 8 is a flow chart illustrating a job switching process according to the second exemplary embodiment.

FIG. 8 is a flow chart illustrating the job switching process (step S13) according to the second exemplary embodiment.

In step S21, the CPU 11 selects a sheet discharge tray presently used for the first job. In step S22, the CPU 11 determines whether the first printing condition for the first job is fulfilled. If the first printing condition is fulfilled (YES in step S22), the process proceeds to step S23. If the first printing condition is not fulfilled (NO in step S22), the process proceeds to step S27. The first printing condition is fulfilled when the drying time of a preceding print medium on the sheet discharge tray of the sheet discharge destination of the first job elapses and no print medium currently under printing is present on the flapper F.

In step S23, the CPU 11 switches the flapper F to the direction of the sheet discharge destination for the first job. In step S24, the CPU 11 executes the printing of the first job on the print medium. The CPU 11 sets the drying time of the first print medium P1 printed in step S24 into a timer in step S25. In step S26, the CPU 11 determines the presence of remaining printing jobs including the first job and the second job. If the remaining printing jobs exist (YES in step S26), the process returns to step S22. On the other hand, if the remaining printing jobs do not exist (NO in step S26), the CPU 11 ends the process.

In step S27, the CPU 11 determines whether the second printing condition for the second job is fulfilled. If the printing condition is fulfilled (YES in step S27), the process proceeds to step S28. If the second printing condition is not fulfilled (NO in step S27), the process returns to step S22. The second printing condition is fulfilled when the drying time of a preceding print medium on the sheet discharge tray of the sheet discharge destination of the second job elapses and no print medium presently under printing is on the flapper F.

In step S28, the CPU 11 switches flapper F to the direction of the sheet discharge destination for the second job. In step S29, the CPU 11 executes the printing of the second job on the print medium. The CPU 11 sets the drying time of the second print medium P2 printed in step S29 into a timer in step S30. Thereafter, the process proceeds to step S26.

According to the second exemplary embodiment, a printing job having a shorter print drying time is inserted and printed during the drying time of a printing job having a longer print drying time, so that the throughput of the entire job for users improves.

Further, the second exemplary embodiment can improve users' productivity in printing processing which involves drying time.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-217381 filed Aug. 23, 2007, which is hereby incorporated by reference herein in its entirety.

What is claimed is:

1. A method for controlling an image forming apparatus including a first discharge unit configured to discharge a printed medium on which a recording agent has been applied, and a second discharge unit configured to discharge a printed medium on which a recording agent has been applied, the method comprising:

causing the first discharge unit to discharge a first printed medium on which the recording agent has been applied;

causing the second discharge unit to discharge a second printed medium on which the recording agent has been applied while performing a drying process to the recording agent applied on the first printed medium which has been discharged by the first discharge unit; and controlling a switching unit to switch a discharge destination of a printed medium between the first discharge unit and the second discharge unit when a printed medium is absent on the switching unit.

2. A method for controlling an image forming apparatus including a first discharge unit configured to discharge a printed medium on which a recording agent has been applied, and a second discharge unit configured to discharge a printed medium on which a recording agent has been applied, the method comprising:

causing the first discharge unit to discharge a first printed medium on which the recording agent has been applied;

causing the second discharge unit to discharge a second printed medium on which the recording agent has been applied while performing a drying process to the recording agent applied on the first printed medium which has been discharged by the first discharge unit;

determining whether the drying process to the recording agent applied on the first printed medium has been finished; and causing the first discharge unit to discharge a third printed medium to be discharged.

3. The method according to claim 2, further comprising determining a drying time of the drying process, wherein the determining whether the drying process has been finished comprises determining whether the drying process has been finished in accordance with the determined drying time.

4. The method according to claim 1, further comprising determining whether a printing job, having a drying time shorter than a time length required for completing the drying process for the first printed medium, exists among printing jobs waiting for print, wherein the causing the second discharge unit to discharge the second printed medium comprises causing the second discharge unit to discharge the second printed medium by giving higher priority to the job determined to have the drying time shorter than the time length required for completing the drying process for the first printed medium.

5. The method according to claim 2, further comprising determining whether a printing job, having a drying time shorter than a time length required for completing the drying process for the first printed medium, exists among printing jobs waiting for print, wherein the causing the second discharge unit to discharge the second printed medium comprises causing the second discharge unit to discharge the second printed medium by giving higher priority to the job determined to have the drying time shorter than the time length required for completing the drying process for the first printed medium.

6. The method according to claim 3, further comprising determining whether a printing job, having a drying time shorter than a time length required for completing the drying process for the first printed medium, exists among printing jobs waiting for print, wherein the causing the second discharge unit to discharge the second printed medium comprises causing the second discharge unit to discharge the second printed medium by giving higher priority to the job determined to have the drying time shorter than the time length required for completing the drying process for the first printed medium.

* * * * *